United States Patent [19]

Daane

[11] Patent Number: 4,462,169

[45] **Date of Patent: * Jul. 31, 1984**

[54] WEB DRYER SOLVENT VAPOR CONTROL MEANS

[75] Inventor: Robert A. Daane, Green Bay, Wis.

[73] Assignee: W. R. Grace & Co., New York, N.Y.

[ * ] Notice: The portion of the term of this patent subsequent to Jan. 25, 2000 has been disclaimed.

[21] Appl. No.: 350,192

[22] Filed: Feb. 19, 1982

[51] Int. Cl.[3] ..... F26B 13/18

[52] U.S. Cl. ..... 34/62; 34/114; 34/122

[58] Field of Search ..... 34/62, 66, 114, 122; 101/416 R, 416 A

[56] References Cited

U.S. PATENT DOCUMENTS

| | | | |
|---|---|---|---|
| 2,157,388 | 5/1939 | MacArthur | 101/416.1 |
| 3,071,869 | 1/1963 | Latimer et al. | 34/114 |
| 3,452,447 | 7/1969 | Gardner | 34/156 |
| 3,733,711 | 5/1973 | Haythornthwaite | 34/114 |
| 4,263,724 | 4/1981 | Vits | 34/62 |
| 4,369,584 | 1/1983 | Daane | 34/122 |

*Primary Examiner*—Larry I. Schwartz
*Assistant Examiner*—David W. Westphal
*Attorney, Agent, or Firm*—James E. Nilles

[57] ABSTRACT

A web that is coated or imprinted on both surfaces has a straight stretch that emerges from a dryer enclosure in which the web is heated and extends to a chill roll around which a curved portion of the web is partially wrapped. A duct-like tunnel surrounding said stretch has its outer end near the chill roll. In a preferred embodiment, a nozzle at the outer end of the upper tunnel wall blows a blade-like jet against the curved portion of the web to force it into intimate engagement with the chill roll periphery and thus prevent accumulations of solvent vapor condensate thereon. Part of the jet air deflected by the web is guided inwardly along the web by the upper tunnel wall. Air outlets just above the lower tunnel wall, near its outer end and spaced at intervals across it, provide for inward air flow under the web. Practically all vapor emanating from the web after it leaves the dryer is thus driven into the dryer.

1 Claim, 2 Drawing Figures

WEB DRYER SOLVENT VAPOR CONTROL MEANS

Field of the Invention

This invention relates to apparatus for drying ink or coating on both surfaces of a lengthwise moving web, comprising a dryer enclosure in which the web is heated for evaporation of solvent from the ink or coating thereon and in the interior of which a subatmospheric pressure is maintained, and a chill roll which is spaced outwardly from the dryer enclosure and with which the web has partial wrapping engagement; and the invention is more particularly concerned with means for preventing accumulations of solvent vapor on the chill roll and for preventing the diffusion of solvent vapor into the air outside the dryer, both of which occurrences have heretofore resulted from evaporation of solvent from the hot portion of the web that extends from the dryer to the chill roll and partway around it.

Background of the Invention

In order to effect quick drying of the ink or coating on a freshly printed or freshly coated web, the web is guided for lengthwise movement from the printing or coating rollers directly through a dryer enclosure in which it is heated to effect rapid evaporation of the solvent in the ink or coating. Air laden with solvent vapor is continuously drawn out of the dryer enclosure and passed through an incinerator or the like that converts the vapor to inoffensive gases which are discharged into the atmosphere. The rate at which air is withdrawn from the dryer enclosure is high enough for maintaining a subatmospheric pressure in its interior. Hence, there is an inflow of air at the slots in opposite walls of the enclosure through which the web enters and leaves the enclosure, and such inflow normally prevents escape of solvent vapor from the enclosure.

From the dryer the web extends to a chill roll around which it has partial wrapping engagement and by which it is cooled to harden the ink or coating on it.

It is well known that the web carries some solvent vapor out of the dryer in a relatively thin boundary layer that tends to cling to each surface of the web. More importantly, there is countinuing evaporation of solvent from the web after it leaves the dryer enclosure, because the web remains at a high temperature until it is cooled by contact with the chill roll. Heretofore it has usually been considered necessary to mount a suction hood over the chill roll and the hot stretch of web extending to it, to draw out of the press room the vapor solvents diffused from that stretch of web.

A particularly troublesome and long standing problem has been posed by the continued evaporation of solvent from the web after the web has left the dryer, in cases where the web has ink or coating on both of its surfaces. One of those surfaces must inevitably contact the chill roll, and the vapor at that surface has a tendency to condense on the cold surface of the chill roll and act as a solvent that softens and smudges the partially dried ink or coating on the web. Often the condensate on the chill roll has caused so-called blocking, wherein ink softened by solvent vapor condensate picked up from the chill roll causes stacked sheets that have been cut from the web to stick together at a station to which the imprinted or coated material is ultimately delivered.

Heretofore, the vapor-rich boundary layer that adheres to the stretch of web extending from the dryer to the chill roll has been regarded as principally responsible for smudging and blocking. An early presentation of this theory appears in U.S. Pat. No. 2,157,388, to MacArthur, issued in 1939, which says: "If the solvent vapors be withdrawn from the presence of the printed material before it cools, then undesired condensation is avoided, but this is difficult to accomplish, particularly in the case of a rapidly traveling web, due, perhaps, to a tendency of the web to sweep along with it those vapors which lie closely adjacent to its surfaces."

The recently issued U.S. Pat. No. 4,263,724 to H. Vits offers substantially the same explanation: "The traveling web tends to carry the vapor of the still vaporizing residual solvent oil along on its surface in the form of a boundary layer conveyed by the web motion, and when this layer of vaporizing solvent oil contacts the exposed portions of the cooling rolls, it can condense to its liquid phase on the roll surfaces and cause a solvent or softening action on the otherwise adequately dried ink. . ." The remedy proposed by Vits is, in general, ". . . pneumatically displacing the described boundary layer at such a position and such a rate as prevents it from contacting and condensing on the exposed surface portion of the roll or rolls with which the printing, or other coating, contacts." Vits discloses one arrangement intended for solving the problem, wherein pressure air is blown against the exposed surface of the chill roll, that is, the portion of the chill roll around which the web is not wrapped. Apparently the purpose of this arrangement is to dislodge from the chill roll the condensed solvent deposited on it by the portion of the web that it has contacted, in order to prevent such solvent from being carried on around into contact with the portion of the web that is newly arriving at the chill roll. The philosophy of this scheme seems to be to minimize the damage that can result from condensation which has occurred on the chill roll, rather than to prevent such condensation in the first place.

Another of the arrangements disclosed by Vits follows the approach of attempting to scrub the boundary layers off of the web before the web arrives at the chill roll. In this arrangement the web moves from the dryer towards the first chill roll through a tunnel which has its outer end near the chill roll and which is communicated at its inner end with the interior of the dryer. Near its outer end this tunnel is formed with a constriction that has walls closely adjacent to the surfaces of the web, and the subatmospheric pressure in the dryer enclosure is relied upon to draw an accelerated airflow through this constriction whereby additional air is induced to flow into the outlet end of the tunnel and thus along the surfaces of the web. In an alternative embodiment, inwardly opening pressure air outlets are placed in the tunnel that are likewise intended to produce a fast flow of air along the web surfaces and inwardly through the tunnel.

Merely producing a fast relative air flow along a web surface is ordinarily insufficient to sweep a vapor-rich boundary layer off of the web, as is brought out in U.S. Pat. No. 3,071,869 to Latimer et al. Furthermore, any effective dispersal of the boundary layer that occurs with the Vits apparatus will take place in a zone some distance into the tunnel from its outer end, where the inward air flow has its maximum velocity; and between that zone and the chill roll there is a substantial length of hot web along which a vapor concentration can reform.

The Latimer et al patent that has just been mentioned is concerned with webs that are imprinted or coated on only one surface, and it discloses means for dispersing the vapor-saturated boundary layer from the portion of the web that is inside the dryer enclosure, in order to speed up evaporation of solvent from the ink or coating. The expedient disclosed by Latimer et al can only disperse the boundary layer from a surface of the web that is remote from a roller around which the web is moving, and therefore it could not be employed to solve the problems which arise at a chill roll, where smudging and picking are the result of evaporation from the web surface that is adjacent to the chill roll.

Thus, in practice, it has been found difficult if not impossible to scrub the vapor-rich boundary layer off of the web just before it reaches the chill roll. It may well be that success in doing so would not achieve a complete avoidance of smudging and picking because the problem involves a phenomenon that develops at the chill roll itself. As pointed out in U.S. Pat. No. 3,452,447, issued to T. A. Gardner in 1969, when a fast moving web comes into wrapping engagement with a rotating cylinder such as a chill roll, a thin film of air tends to be trapped between the web and the peripheral surface of the roller and to underlie all of the surface of the web that is supposed to be in contact with the roller. In the case of a chill roll, the trapped air acts as an insulation that interferes with the transfer of heat from the web to the chill roll, so that the web remains hot even after it has passed around a substantial portion of the chill roll circumference. Therefore vapor continues to be emitted into the intervening air film, from which it is recondensed onto the chill roll.

This air film between the web and the chill roll appears to be a major cause of problems at the chill roll because it allows a substantial amount of condensate to build up on the chill roll surface, forming rather thick layers or ribbons from which condensate is intermittently reabsorbed by the web to resoften the ink. If the printed or coated web has good contact with the chill roll, the web will be more quickly cooled to below the vaporizing temperature of the solvent, and such condensate as forms on the chill roll is not able to accumulate on the chill roll surface because the web will continuously reabsorb it.

For forcing a web into intimate contact with a roller, the Gardner patent proposes an air bar that extends across the web and emits two jets of pressure air towards it at opposite oblique angles to its surface such that the jets converge towards one another. As brought out in the copending U.S. patent application of R. A. Daane, Ser. No. 254,989, filed Apr. 16, 1981, now U.S. Pat. No. 4,369,584 (which has a common assignee with the present application), it is doubtful whether the air bar arrangement proposed by Gardner would actually be effective unless web speeds were rather low and web tensions were maintained at a relatively high value. In any case, a reasonably effective air bar device of the type disclosed by Gardner would have to discharge a high volume of air at a high velocity and would therefore have to be supplied with pressure air from a powerful fan or blower.

Summary of the Invention

The general object of the present invention is to provide, in web drying apparatus of the type comprising a dryer enclosure and a chill roll and wherein a stretch of hot web normally extends from the dryer enclosure to the chill roll, means for constraining substantially all solvent vapors emanating from that stretch of web to flow into the dryer enclosure so that no suction hood is needed over the chill roll, and for forcing the web into intimate contact with the surface of the chill roll to prevent the formation of an air film that insulates the web from the chill roll.

Thus it is also a general object of this invention to provide effective means, in web drying apparatus of the character described, for preventing dispersal of solvent vapors into the press room and for preventing smudging and the like at the chill roll.

It is also an important objective of this invention to accomplish the above stated objects with apparatus that is simple and inexpensive in itself and operates with relatively low expenditure of energy.

Another and more specific object of the invention is to provide apparatus of the character described wherein the nozzle device disclosed in the above-identified Daane application, Ser. No. 254,989, is employed in combination with other structure not only to bring about the expectable result of maintaining intimate contact between the web and the chill roll but also to bring about new and unexpected results, namely, preventing smudging and similar problems and preventing dispersal of solvent vapors into the press room by constraining such vapors to flow into the dryer, so that all solvent evaporated from the web can be readily passed through a vapor incinerator or pollution device for preventing air pollution.

It is also an object of the present invention to provide apparatus of the character described that effectively prevents solvent vapor from belching out of the dryer enclosure from time to time, as has occurred with most prior web drying apparatus.

Brief Description of Drawings

In the accompanying drawings, which depict what is now regarded as a preferred embodiment of the present invention.

Figure 1:
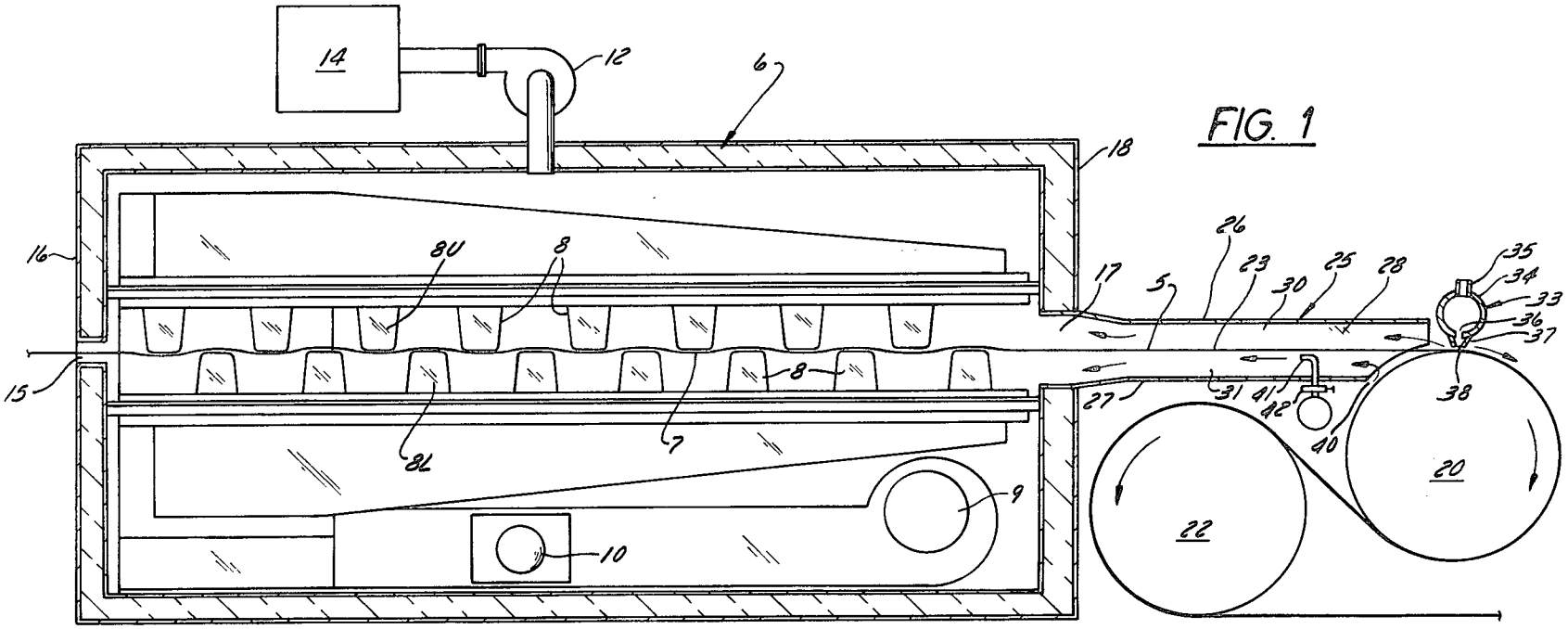
FIG. 1 is a more or less diagrammatic view in vertical section of web drying and cooling apparatus that embodies the principles of this invention.

Detailed Description of Preferred Embodiment of the Invention

As is conventional, a lengthwise moving web 5 of paper or the like, after having both of its surfaces imprinted with ink or coated with an ornamental or protective coating, is passed through an oven or dryer enclosure 6 wherein the web is heated to cause evaporation of the solvent from its ink or coating.

The web 5 has a straight stretch 7 that extends through the dryer 6, and that stretch is contactlessly supported by pressure air issuing from a series of air bars 8 that are mounted in the interior of the dryer enclosure. Each air bar 8 is oriented with its length extending across the width of the web, and the several air bars are parallel to one another and spaced apart at relatively small intervals along the length of the web. In addition to a set of air bars 8L that are arranged below the web to direct supporting air streams upwardly against it, another set of air bars 8U is arranged above the web to direct air streams downwardly against it and thus confine the web to straight line motion through the dryer enclosure. Pressure air is supplied to the air bars 8 from a blower 9, and such air may be passed through a heater 10 on its way to the air bars so that the streams of air that issue from the air bars not only afford floating support for the web but also heat the web from above and below, to effect evaporation of solvent from ink or coating on both of its surfaces. Alternatively, the web could be directly heated by the flames of fuel burners (not shown) that would be mounted in the dryer enclosure in a known arrangement.

An exhaust fan or blower 12 withdraws air from the dryer enclosure 6 at a rate somewhat higher than that at which the pressure air blower 9 supplies air to the air bars 8, to thus maintain a subatmospheric pressure in the interior of the dryer. The air thus withdrawn from the dryer, which is laden with solvent vapor, may be conducted to an incinerator 14 at which the entrained solvent vapor is converted to harmless gases. The heater 10 for the pressure air flowing from the pressure air blower 9 to the air bars 8 may comprise a heat exchanger whereby the pressure air is heated from the exhaust air leaving the incinerator.

To maintain the desired subatmospheric pressure in the dryer 6, its walls are for the most part imperforate. However, the web 5 moves into the dryer enclosure through an inlet slot 15 in one wall 16 of the enclosure and emerges through an outlet slot 17 in an opposite wall 18. The subatmospheric pressure in the dryer induces air to flow inwardly through both of the web slots 15 and 17, thereby normally preventing escape of vapor from the dryer.

The web 5 extends in a straight path from the interior of the dryer enclosure 6, through the outlet slot 17, to a chill roll 20 around which the web has partial wrapping engagement and which is spaced at some distance outwardly from the dryer wall 18 that has the outlet slot 17 therein. Conventionally the web may continue from the chill roll 20 to a second chill roll 22 around which the web has an opposite wrap, so that the second chill roll 22 contacts the surface of the web that was not engaged by the first chill roll 20. Although not shown, it will be understood that the web may pass around one or more further chill rolls. In any case, the first chill roll 20 is the one at which smudging is most likely to occur.

A long, straight stretch 23 of unsupported web that extends between the dryer 6 and the first chill roll 20 constitutes, in effect, a continuation of the straight stretch 7 inside the dryer that is floatingly supported by the air streams issuing from the air bars 8. When the web emerges from the dryer, it draws with it boundary layers that are saturated with solvent vapor, and solvent continues to evaporate as the web moves towards the chill roll 20, so that a substantial amount of vapor tends to be dispersed from the web stretch 23. With prior web drying apparatus, the so-called belching of smoke from the dryer oven, due mainly to dispersal of vapor from the hot web stretch just outside the dryer, required the provision of a suction hood whereby such vapor was drawn out of the press room.

In the apparatus of this invention the web stretch 23 that extends between the dryer 6 and the first chill roll 20 is surrounded by the walls of a duct or tunnel 25 that constitutes, in effect, an extension of the dryer enclosure. At an inner end of the tunnel 25, where it is joined to the wall 18 of the dryer, the dryer outlet slot 17 opens into it. The outer end of the tunnel 25 is adjacent to the chill roll 20.

The upper and lower walls 26, 27 of the tunnel 25, which are substantially flat and parallel to one another and which respectively oppose the upper and lower surfaces of the web stretch 23, are spaced apart by a relatively small distance, just sufficient to ensure that they will not be contacted by the web. The side walls 28 of the tunnel are spaced apart by a distance slightly greater than the width of the web, just sufficient to avoid being contacted by its side edges. The web stretch 23 thus has the effect of dividing the interior of the tunnel 25 into upper and lower channels 30, 31, through each of which an airstream can move inwardly. Preferably the tunnel walls 26, 27, 28 are provided with heat insulation so that solvent vapors emanating from the stretch of web 23 will not condense on their inner surfaces.

The upper wall 26 of the tunnel has its outer end adjacent to an air jet nozzle 33 of the type that is more fully described and explained in the above-mentioned Daane application. In general, the nozzle 33 comprises a straight pipe or duct 34 that has a pressure air inlet 35 at one of its ends and is plugged at its other end. The length of the pipe or duct 34 is such that it extends across the full width of the web. Holes 36 in the pipe 34, in a row along its bottom, open into the outlet portion of the nozzle 33, which is defined by a pair of downwardly convergent plates 37 that have their upper edges welded or otherwise sealingly connected to opposite sides of the pipe 34. The lower edges of the plates 37 are spaced apart to define an outlet slit 38 which extends along the full length of the pipe 34 (i.e., all across the web) and which is just wide enough to ensure that pressure air will issue therefrom at a substantially uniform rate all along its length. Typically the width of the outlet slit 38 is 0.030 inch.

The nozzle 33 is mounted at such an orientation that the jet issuing from its outlet slit 38 is directed radially inwardly relative to the chill roll 20. The nozzle 33 is situated so close to the chill roll 20 as to afford substantially only a good clearance for the web, to ensure that its jet does not broaden, disperse or lose much velocity before it impacts the web; and, specifically, the nozzle 33 should not be spaced from the web by more than about four times the width of its outlet slit 38. Furthermore, the location of the nozzle 33 should be such that its outlet is close to a line of tangency of the web to the chill roll 20, said line being the imaginary line that extends along the peripheral surface of the chill roll at the boundary between the straight stretch 23 of the web and the curved stretch of web that is partially wrapped around the chill roll. The nozzle 33 is preferably spaced a short distance in the direction of web motion from the line of tangency, so that its jet impacts the curved portion of the web, but it should not be spaced in the opposite direction from that line.

As more fully explained in the Daane application, the purpose of the nozzle 33 is to subject the web to a high pressure gradient in the direction of web motion. The air jet issuing from the nozzle 33 need not exert a force upon the web that is particularly high in itself. The factor that is significant is that within the narrow zone in which the web is impacted by the blade-like jet from the nozzle 33, that jet subjects the web to a pressure which has a rapid rate of rise in the direction of web motion; and it is this rapid change in the relationship between pressure and distance along the web that accounts for the ability of the jet to force the web into intimate contact with the chill roll periphery. Since the jet in effect squeezes away the air film from between the web and the chill roll, the web remains in contact with the chill roll after passing the jet. The nozzle is therefore located fairly close to the line of tangency—preferably not more than ½ inch (12 or 13 mm.) beyond it—to ensure that as much as possible of the curved stretch of web around the chill roll will be in contact with the chill roll surface.

It has been found that a nozzle 33 of the above described character, having an outlet slit width of 0.030 in. (about 0.75 mm.) is highly effective when pressure air is fed to it at 3 psig. Obviously, not much energy is consumed in supplying air at this relatively modest pressure.

The air jet issuing from the nozzle 33 moves towards the web substantially at right angles to the local surface area of the web that it impacts, and therefore the jet is so deflected by the web that about half of the emitted air moves along the web surface in the direction of web motion and the other half moves along the web oppositely to web motion. Because the outer end of the upper tunnel wall 26 is contiguous to the nozzle 33, the portion of the deflected jet that moves in counterflow to the web is constrained to enter the tunnel 25 and to flow inwardly in the upper channel 30 thereof. The inward flow of air thus produced by the nozzle 33 is of course promoted and intensified by the subatmospheric pressure in the interior of the dryer, with which the tunnel communicates through the web outlet slot 17. As a result, all vapor dispersed from the upper surface of the web between the dryer wall 18 and the jet nozzle 33 is forced back into the dryer enclosure 6 for eventual passage through the incinerator 14.

The impact of the jet from the nozzle 33 against the web is effective to scrub the vapor-rich boundary layer off of the upper surface of the web and force all of that vapor into and along the tunnel 25; therefore the portion of the jet air that is deflected along the web in the direction away from the tunnel is essentially clean air. It may well be that a vaporrich boundary layer begins to reform on the upper surface of the portion of the web that has passed the nozzle 33 and is passing around the chill roll 20, but no significant dispersion of such vapor takes place because of the relatively rapid cooling to which that portion of the web is subjected, first by the air from the nozzle 33 and then by reason of the intimate contact between the web and the chill roll 20.

As for the bottom surface of the web, which comes into contact with the chill roll 20 around a substantial portion of its periphery, there may be a vapor-rich boundary layer attached to that surface when it arrives at the chill roll, but that boundary layer will in effect be squeezed away from between the web and the chill roll by the action of the jet from the nozzle 33.

Furthermore, substantially all of the solvent vapor generated at this bottom surface of the web, up to the point where it comes into contact with the chill roll, is caused to flow into the dryer enclosure 6 by the apparatus of this invention. To that end, the lower wall 27 of the tunnel 25 has its outer end spaced a small distance from the first chill roll 20 to cooperate with that chill roll in defining a slot-like inlet 40 through which air can be drawn into the lower air channel 31. Inside the tunnel, near its outer end and adjacent to its bottom wall 27, there are a plurality of pressure air outlets 41 which open inwardly relative to the tunnel and which are spaced from one another at intervals across the width of the tunnel. The streams of pressure air emitted from these outlets induce a substantial flow of air into the tunnel through the slot-like inlet 40, and such induced air flow sweeps along with it the free vapor that is adjacent to the exposed surface of the chill roll 20 and the bottom surface of the web near that chill roll.

The air flow produced and induced by the air outlets 41 serves to impose forces upon the lower surface of the web that balance those forces imposed upon its upper surface by air moving through the tunnel from the nozzle 33. The rate at which pressure air is delivered to the outlets 41 is preferably controllable, as by means of a manually adjustable throttling valve 42, to provide for so balancing the air flows along the opposite surfaces of the web as to maintain steady, straight line motion of the stretch of web extending through the tunnel 25.

Of course the inward flow of air due to the air outlets 41 also serves to propel into the dryer enclosure 6 substantially all of the vapor that tends to diffuse from the bottom surfaces of the web, thus preventing diffusion of such vapor into the press room without the need for a suction hood. In this respect it will be observed that the induced inflow of air at the slot-like inlet 40 prevents the escape of free vapor through that aperture. Of course the airflow along the bottom surface of the web stretch 23, like that along its top surface, has some effect in cooling the web, particularly in the portion of the stretch 23 that is near the chill roll 20 and the outer end of the tunnel. However, the amount of air moved along this stretch 23 of the web is not great enough to effect any substantial amount of web cooling. Economically small rates of pressure air flow from the nozzle 33 and from the air outlets 41 are adequate to prevent condensation of vapor on the chill roll 20 and diffusion of vapor into the press room, and more than an adequate airflow through the tunnel 25 could adversely affect operation of the dryer exhaust fan 12 and the vapor incinerator 14, as well as being wasteful in itself.

Figure 2:
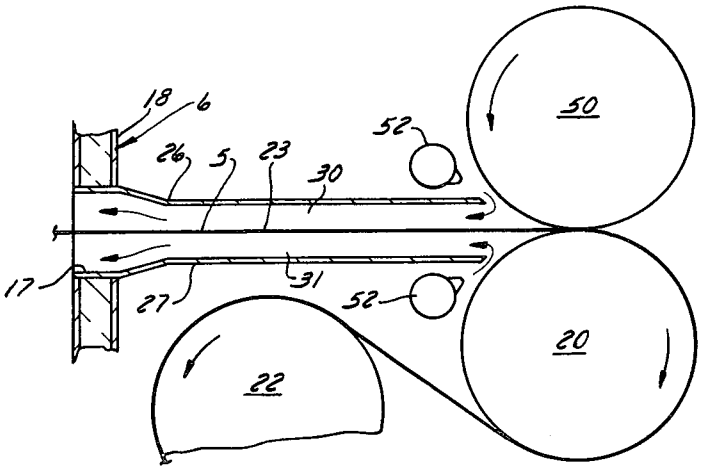
FIG. 2 is a view in vertical section of a modified form of web drying and cooling apparatus of this invention.

The embodiment of the invention illustrated in FIG. 1 is preferred for most installations, but the modified embodiment shown in FIG. 2 may be suitable under some conditions. In FIG. 2, the nozzle 33 for producing a blade-like high velocity air jet whereby the web is forced into intimate contact with the chill roll 20 is replaced by a cooled roller 50, which cooperates with the chill roll 20 to define a nip through which the web passes in moving into its partially wrapping engagement with the chill roll 20. The cooperating rolls 20 and 50 can have an adjustable nip clearance maintained at about 0.001 in. less than the web thickness or they can be arranged in a known manner to provide a controlled nip load. The outer end of the lower tunnel wall 27 is near the chill roll 20, as in the FIG. 1 embodiment, and the upper tunnel wall 27 is similarly spaced from the cooled pressure roller 50. Air is induced to flow into the tunnel, around the outer end of each of the tunnel walls 26 and 27, by means of air jet nozzles 52, each located outwardly adjacent to one of those tunnel walls and arranged to blow air obliquely towards the outer end of the tunnel wall and towards the adjacent roller and the web. Since the substmospheric pressure in the dryer enclosure 6 will induce some air flow inwardly around the outer ends of the upper and lower tunnel walls, the nozzles 52 are so arranged as to ensure particularly good airflow on those portions of the peripheries of rollers 20 and 50 that are adjacent to the edges of the web, where accumulations of condensate are most likely to form.

From the foregoing description taken with the accompanying drawings it will be apparent that this invention provides simple, economical and effective means in web drying apparatus of the character described for preventing accumulations of solvent vapor condensate on the chill roll, thereby preventing smudging and the like, and for preventing diffusion of solvent vapor into the press room outside the dryer enclosure by forcing into that enclosure substantially all vapor emanating from the stretch of web that extends between the dryer and the chill roll. It will be apparent that the apparatus of this invention not only eliminates the need for a suction hood outside the dryer but causes the vapor which would otherwise be picked up by such a hood to be forced through the incinerator that reduces solvent vapor to inoffensive gases.

What is claimed as the invention is:

1. Web drying apparatus comprising dryer walls defining an enclosure wherein a lengthwise moving web is heated for evaporation of solvent from coating or printing on at least one surface thereof and from which the web emerges through a slot in one of said dryer walls, means for maintaining a subatmospheric pressure in said enclosure, and a chill roll spaced outwardly from said one dryer wall to which a straight portion of the web extends from said slot and around which a curved portion of the web is partially wrapped with said one surface adjacent to the chill roll, the boundary between said portions of the web being at a line of tangency, said apparatus being characterized by:

A. nozzle means adjacent to the chill roll, having an outlet from which pressure air issues as a jet,
  (1) said outlet being in the form of a slit which
    (a) extends lengthwise substantially entirely across the width of the web and
    (b) is not substantially wider than is adequate to ensure issuance of pressure air therefrom at a substantially uniform rate all along its length,
  (2) said outlet being located and oriented to direct said jet
    (a) against said curved portion of the web at a distance of not substantially more than one-half inch from said line of tangency and
    (b) substantially radially inwardly relative to the chill roll, and
  (3) said outlet being close enough to the chill roll to avoid substantial divergence of the jet before it impinges the web;

B. duct means defining a tunnel extending outward from said one dryer wall and into an inner end of which said slot opens, said duct means comprising a pair to tunnel walls between which said straight portion of the web extends and each of which opposes a surface of the web,
  (1) one of said tunnel walls having an outer end near said chill roll that cooperates with the chill roll to define an inlet for air that flows inwardly between said one tunnel wall and said one surface of the web, and
  (2) the other of said tunnel walls having an outer end closely adjacent to said nozzle means outlet and serving to guide inwardly along the opposite surface of the web a part of the pressure air that has issued from said nozzle means and has been deflected by the web; and C. air outlet means arranged to define a plurality of pressure air outlets in the tunnel which are inwardly adjacent to said one tunnel wall and to said inlet, are spaced from one another across the width of that wall, and open towards said inner end of the tunnel, for blowing air inwardly through the tunnel, inducing flow of air through said inlet, and imposing forces upon said one surface of the web that balance the forces imposed upon its said opposite surface by air moving inward through the tunnel from said nozzle means.

* * * * *